US009038617B1

(12) United States Patent
Khoshnood et al.

(10) Patent No.: US 9,038,617 B1
(45) Date of Patent: May 26, 2015

(54) ARCHERY BOW VIBRATION DAMPENING AND BALANCING DEVICE

(71) Applicants: Bahram Khoshnood, Alpharetta, GA (US); David L. Potts, New Philadelphia, OH (US)

(72) Inventors: Bahram Khoshnood, Alpharetta, GA (US); David L. Potts, New Philadelphia, OH (US)

( * ) Notice: Subject to any disclaimer, the term of this patent is extended or adjusted under 35 U.S.C. 154(b) by 63 days.

(21) Appl. No.: 13/735,162

(22) Filed: Jan. 7, 2013

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
USPC ..... 124/86, 88, 89; 403/162
See application file for complete search history.

(56) References Cited

U.S. PATENT DOCUMENTS

| | | | | | |
|---|---|---|---|---|---|
| 384,297 | A * | 6/1888 | Sweett | 403/162 |
| 459,097 | A * | 9/1891 | Kenyon | 403/35 |
| 1,853,153 | A * | 4/1932 | Skeel | 403/162 |
| 3,342,172 | A * | 9/1967 | Sanders | 124/23.1 |
| 3,502,062 | A * | 3/1970 | Shurts | 124/23.1 |
| 4,491,123 | A * | 1/1985 | Wirtz | 124/89 |
| 5,239,977 | A * | 8/1993 | Thomas | 124/89 |
| 6,257,220 | B1 * | 7/2001 | McPherson et al. | 124/89 |
| 6,634,348 | B2 * | 10/2003 | Gallops, Jr. | 124/25.6 |
| 2003/0056779 | A1 * | 3/2003 | Gallops, Jr. | 124/89 |

* cited by examiner

*Primary Examiner* — John Ricci
(74) *Attorney, Agent, or Firm* — Rodgers & Rodgers

(57) ABSTRACT

An archery bow vibration dampening and balancing device is attachable to an archery bow by means of an elongated clamp with a housing pivotably interconnected to the elongated clamp opposite the attachment point. A vibration dampening and balancing device is secured in an opening formed in the housing.

5 Claims, 6 Drawing Sheets

ARCHERY BOW VIBRATION DAMPENING AND BALANCING DEVICE

BACKGROUND OF THE INVENTION

Modern archery bows are highly sophisticated and during use are under substantial tension so that when the bow string is manipulated and released, substantial vibration is transmitted through the bow limbs to the bow riser and ultimately to the archer's hand. This naturally alters the accuracy of an archery shot.

Archery vibration dampening devices typically are attached to the bow in a permanent fashion which doesn't allow for adjustability of the dampening device. It is desirable that adjustments to the position and location of the device be made in response to varying conditions encountered during use of the archery bow to balance the bow and adjust the weight distribution to accommodate various accessories installed on the bow.

BRIEF SUMMARY OF THE INVENTION

An archery bow vibration, dampening and balancing device is attached to an archery bow by means of an elongated arm or clamp attachable to the bow riser by a rod or pin extending inwardly or outwardly from the archery bow riser. A housing is pivotally attached to the elongated arm or clamp remote from the rod or pin.

The housing is generally circular in configuration and includes an inner opening to receive a vibration dampening or balancing device. The devices are conveniently interchangeable depending on surrounding conditions and varying requirements of the archer.

DETAILED DESCRIPTION OF THE INVENTION

Figure 6:
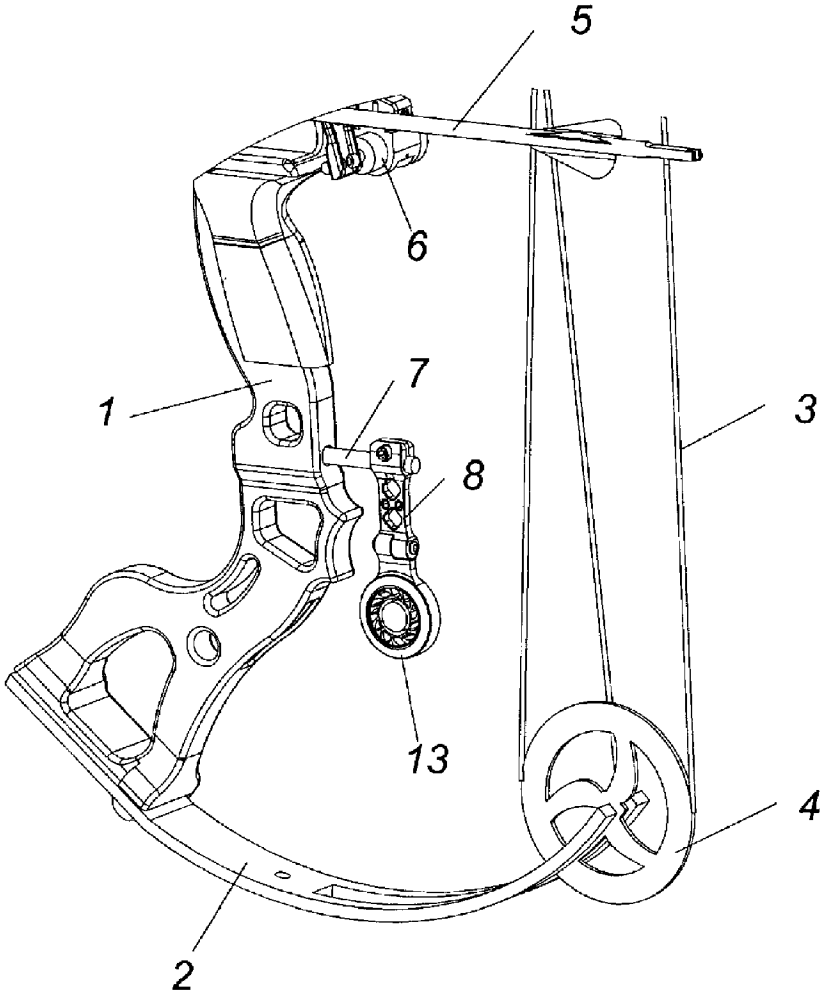
FIG. 6 is a perspective view of the device mounted on an archery bow.

In the drawings and with particular reference to FIG. 6, a conventional archery bow is depicted in which a portion of the archery bow includes riser 1 with flexible limb 2 secured to the lower end of riser 1. Not shown in the drawing is a second flexible limb extending from the upper end of riser 1. As is well known, bow string 3 is strung around cam 4 mounted on the end of the split rail section of flexible limb 2. In like manner, bow string 3 is strung around a like cam affixed to the free end of the upper flexible rib, also not shown in the drawings. To complete the basic elements of the bow, arrow 5 is interconnected to bow string 3 and archery sight 6 is affixed to riser 1 in known manner. Finally, rod 7 extends inwardly or outwardly of the bow from riser 1.

According to this invention, an archery bow vibration dampening and balancing device is provided and includes elongated arm or clamp 8 having compressible arms 9 and 10 extending from one end thereof which are manipulated either inwardly or outwardly by means of threaded screw 11. Journal 12 is affixed to the end of elongated clamp 8 remote from compressible arms 9 and 10.

Figure 1:
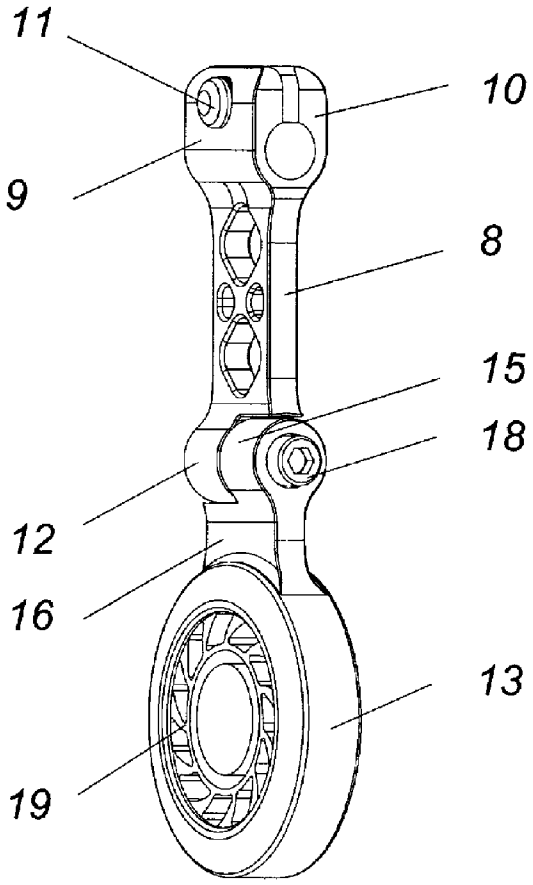
FIG. 1 is a perspective view of the archery bow vibration dampening and balancing device according to this invention.
Figure 2:
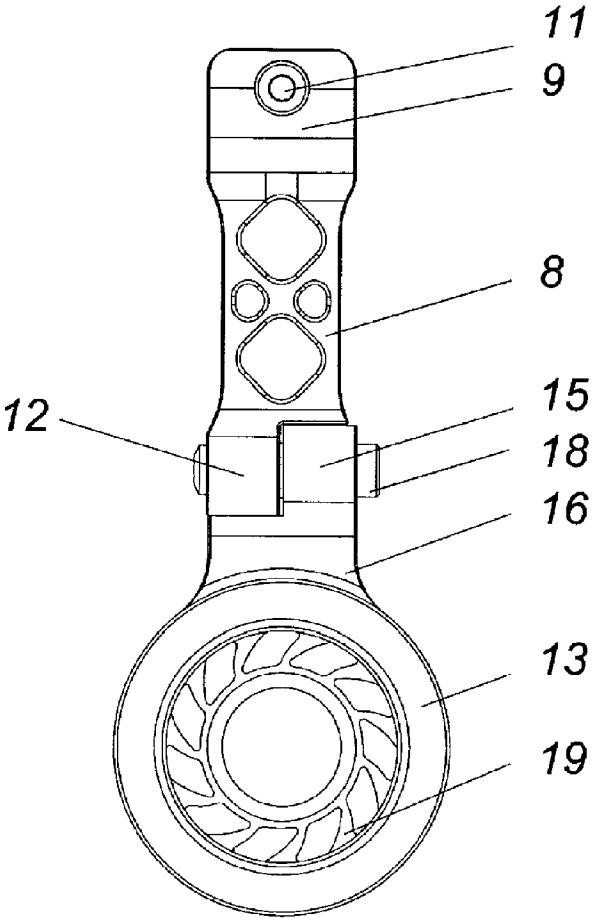
FIG. 2 is a side elevational view of the device.

Also, according to this invention, housing 13 is provided and includes opening 14 formed therein. Although housing 13 is shown as being circular, other shapes can also be employed such as a square, rectangle, triangle etc. Journal 15 is attached to housing 13 by means of attachment arm 16. In order to provide the pivoting feature of the device, journals 12 and 15 are positioned side by side, as shown in FIGS. 1-3, with bushing 17 positioned within both journals 12 and 15 with journals 12 and 15 secured together by means of fastener 18.

In order to provide the vibration dampening feature for the device, dampening device 19 is provided and includes outer rib 20. Dampening device 19 is positioned within housing 13 such that outer rib 20 is engaged in groove 21 formed on the inner surface of housing 13. In order to provide desired balancing for the archery bow, weight balancing and vibration dampening device 22 of a size and weight satisfying the needs of the archer is provided and is positioned within housing 13 in the same manner as dampening device 19.

In operation, the vibration dampening and balancing device, according to this invention, is installed on the archery bow by first untightening screw 11 such that compressible arms 9 and 10 are separated a sufficient distance so that the device is mounted by tightening compressible arms 9 and 10 onto archery bow rod 7 in the manner shown in FIG. 6 by tightening screw 11. Alternatively, the vibration dampening and balancing device can be attached directly to the bow rather than onto rod 7.

Figure 3:
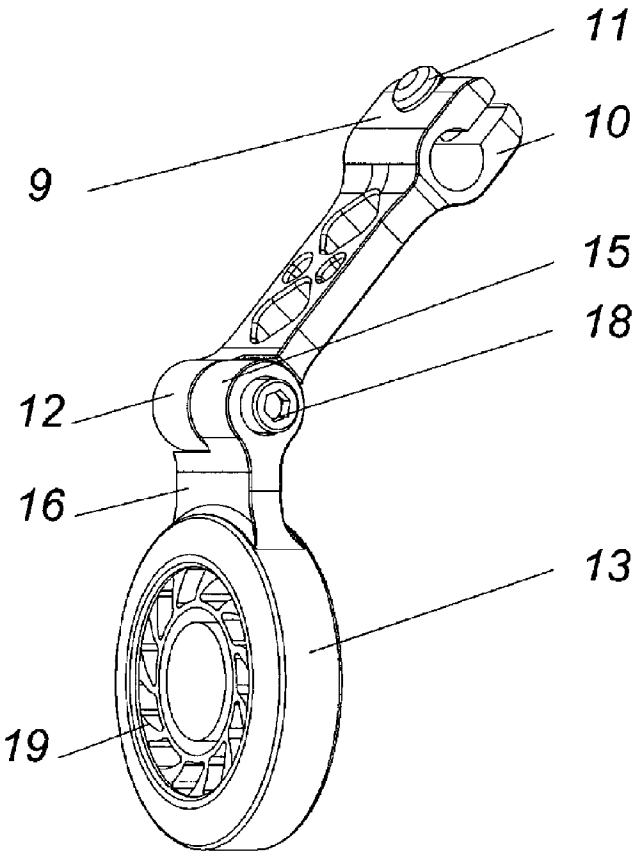
FIG. 3 is a perspective view depicting the pivotal feature of the device.
Figure 4:
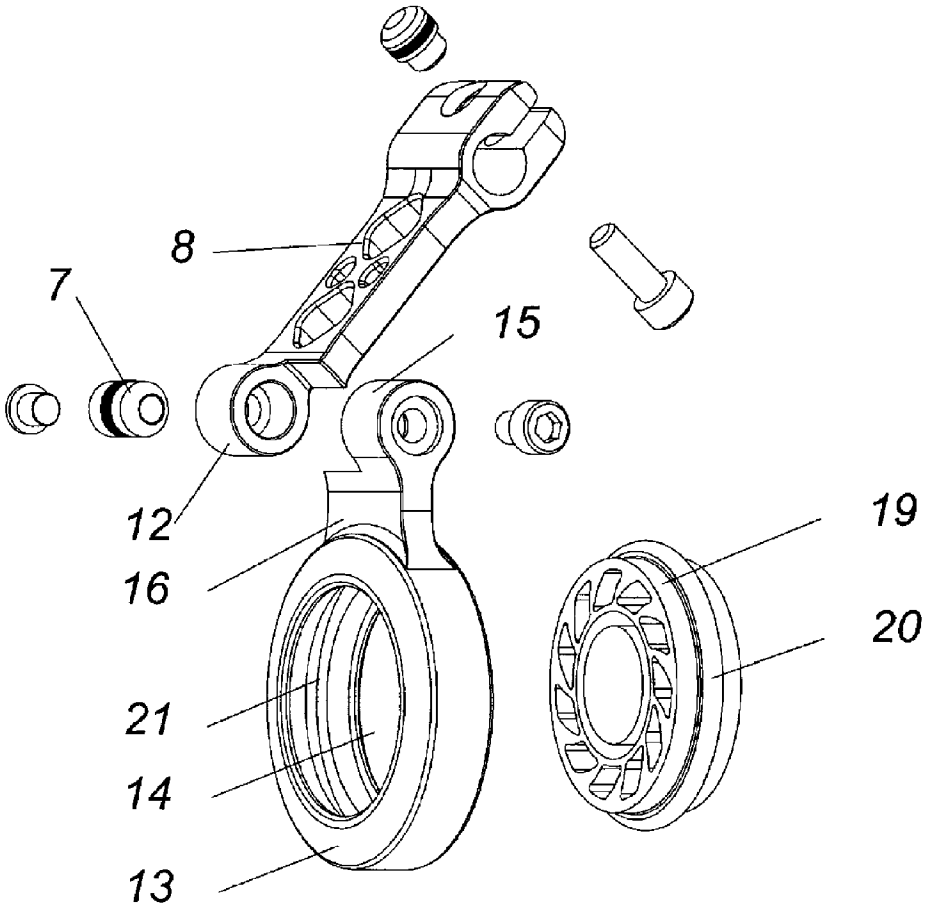
FIG. 4 is an exploded view of one form of the device.
Figure 5:
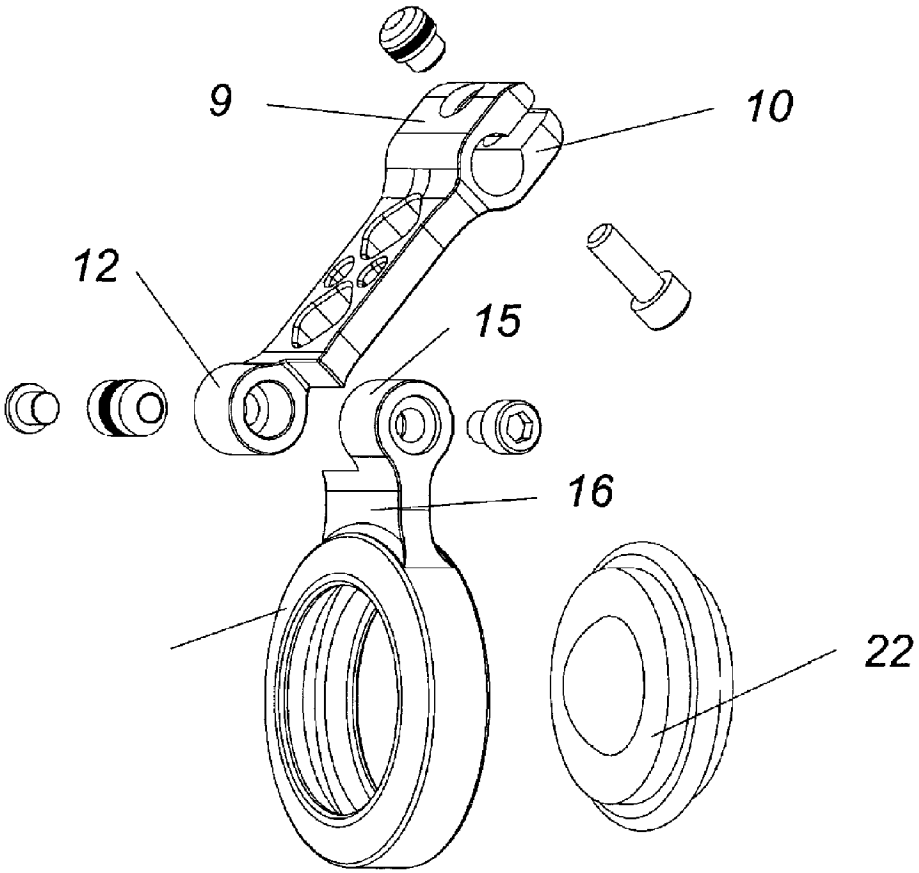
FIG. 5 is an exploded view of modification of the invention.

Through the process of trial and error, for the purpose of vibration dampening and balancing of the bow, housing 13 and the associated devices 19 or 22 are simply pivoted about bushing 17 to the desired position, for example, as shown in FIG. 3.

The invention claimed is:

1. An archery bow vibration dampening and balancing device comprising an elongated clamp attachable to an archery bow, a housing pivotably interconnected to said elongated clamp, said housing comprising an inner opening, and a groove formed on the inner surface of said housing.

2. A device according to claim 1 wherein said elongated clamp comprises a pair of compressible arms extending from one end thereof opposite said housing.

3. A device according to claim 1 wherein a vibration dampening and/or balancing device is disposed in said opening and includes an outer rib.

4. A device according to claim 3 wherein said outer rib is disposed in said groove.

5. A device according to claim 1 wherein the pivotable interconnection between said housing and said elongated clamp comprises a pair of side by side journals interconnected by a fastener.

* * * * *